United States Patent [19]

de Jesus

[11] 4,166,617

[45] Sep. 4, 1979

[54] FIELD GAME

[76] Inventor: Angel de Jesus, 559 W. 172nd St., #1A, New York, N.Y. 10032

[21] Appl. No.: 920,737

[22] Filed: Jun. 30, 1978

[51] Int. Cl.[2] ..... G09B 67/00; G09B 43/02

[52] U.S. Cl. ..... 273/95 H

[58] Field of Search ..... 273/95 H, 95 R, 58 R, 273/64

[56] References Cited

U.S. PATENT DOCUMENTS

| | | | |
|---|---|---|---|
| 1,433,437 | 10/1922 | Wakeham | 273/95 H |
| 2,545,615 | 3/1951 | Hatley | 273/95 H X |
| 2,746,340 | 5/1956 | Sislak | 85/36 |
| 2,993,696 | 7/1961 | Demaline | 273/95 H |
| 3,427,022 | 2/1969 | Ward | 273/58 R X |
| 3,554,551 | 1/1971 | Apiki | 273/95 H |
| 3,920,245 | 11/1975 | Gothreaux et al. | 273/95 H |
| 3,948,521 | 4/1976 | Warren | 273/95 H X |
| 3,994,497 | 11/1976 | Cordingley | 273/95 H |
| 4,037,837 | 7/1977 | Bauer | 273/95 H X |
| 4,088,319 | 5/1978 | Clarke | 273/58 R |

*Primary Examiner*—William H. Grieb

*Attorney, Agent, or Firm*—Daniel Jay Tick

[57] ABSTRACT

A field is marked with first and second spaced generally parallel lines of equal length having spaced opposite first and second ends and twelve player positions marked thereon. First and second leader positions are marked on a central line equidistant from the ends of the line and extending perpendicular thereto. The first leader position is considerably closer to the second line than the first line and the second leader position is considerably closer to the first line than the second line. A plurality of lines extends from the first leader position to each player position on the first line and a plurality of lines extends from the second leader position to each player position on the second line. A pair of identical oval balls are different in color from each other. Each of the balls has a handle member extending coaxially from one axial end thereof.

4 Claims, 2 Drawing Figures

FIELD GAME

BACKGROUND OF THE INVENTION

The present invention relates to a field game. More particularly, the invention relates to a field game played by two teams each consisting of a leader and twelve players.

Field games similar to that disclosed herein are described in U.S. Pat. Nos. 1,433,437; 2,545,615; 2,746,340; 2,993,696; 3,920,245 and 3,948,521.

Objects of the invention are to provide a field game of simple structure, learned with facility and convenience, which game provides considerable exercise, entertainment, amusement, enjoyment and interest.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The field game of the invention is played by two teams, each consisting of a leader and twelve players. In the illustrated embodiment of FIG. 1, the first team is assumed to be the white team and its members are uniformly dressed, presumably in white. The second team is assumed to be the red team and its players are assumed to be uniformly dressed in red.

Figure 1:
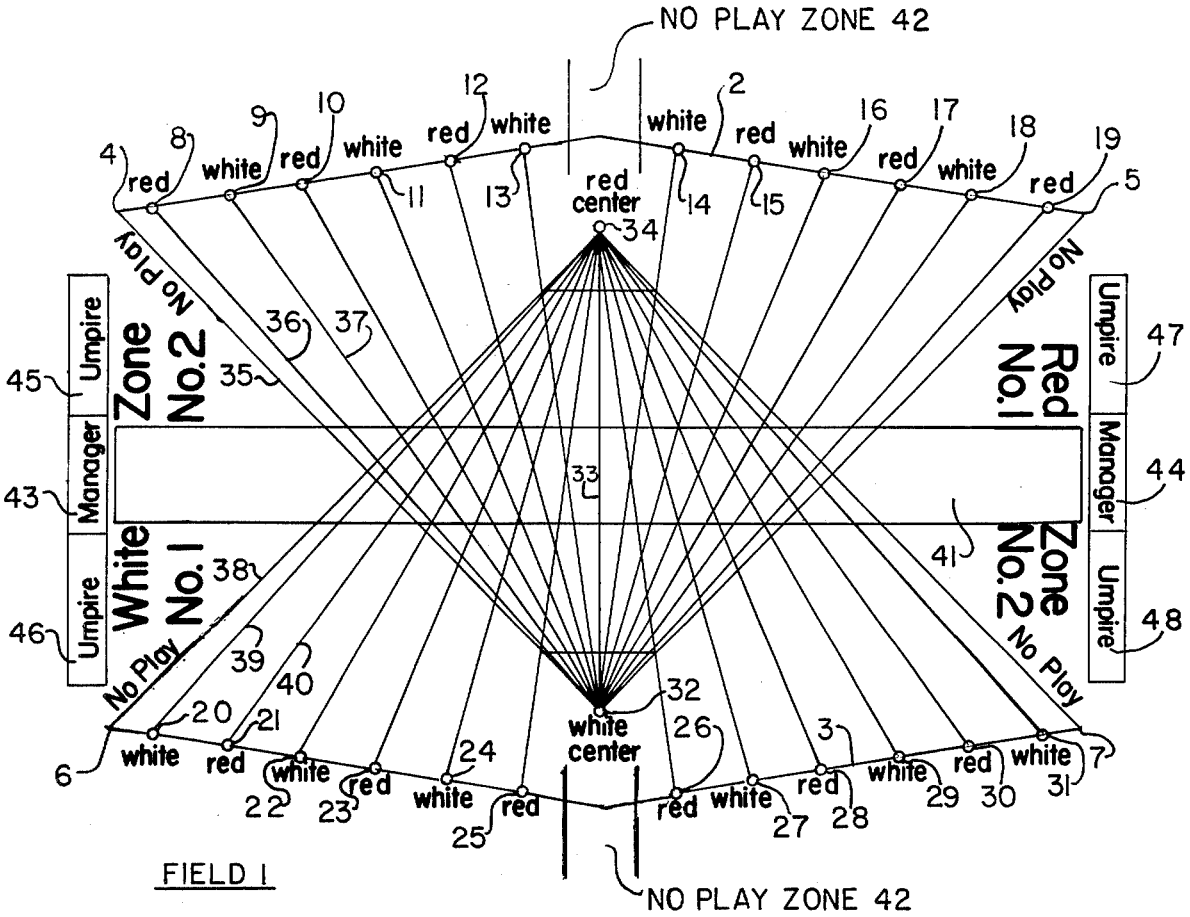
FIG. 1 is a top plan view of the field game of the invention.

As shown in FIG. 1, a field 1 is marked with first and second spaced generally parallel lines 2 and 3, respectively of equal length. The first line 2 has spaced opposite first and second ends 4 and 5, respectively, and the second line 3 has spaced opposite first and second ends 6 and 7, respectively. Twelve player positions 8, 9, 10, 11, 12, 13, 14, 15, 16, 17, 18 and 19 are marked on the first line 2. Twelve player positions 20, 21, 22, 23, 24, 25, 26, 27, 28, 29, 30 and 31 are marked on the second line 3.

A first leader position 32 is marked on a center line 33 equidistant from the ends 4 and 5, and 6 and 7, of the lines 2 and 3, respectively, and extends substantially perpendicularly to said lines. The first leader position 32 is considerably closer to the second line 3 than to the first line 2. A second leader position 34 is marked on the center line 33 and is considerably closer to the first line 2 than to the second line 3. A plurality of lines 35, 36, 37, and so on, extend from the first leader position 32 to each player position 8 to 19, respectively, on the first line 2. A plurality of lines 38, 39, 40, and so on, extend from the second leader position 34 to each player position 20 to 31, respectively, on the second line 3.

The center player positions 13 and 14 on the first line 2 on each side of the center line 33, and next-adjacent thereto, are for the players of the first white team and the player positions from each of the said center player positions to each end 4 and 5 of the first line are alternately for the players of the second and first teams. Thus, the player positions 13, 11 and 9, on one side of the center line and the player positions 14, 16 and 18 on the other side of said center line are for the players of the first team, whereas the players positions 12, 10 and 8 on one side of said center line and the player positions 15, 17 and 19 on the other side of said center line are for the players of the second team.

The center player positions 25 and 26 on the second line 3 on each side of the center line 33 and next-adjacent thereto, are for the players of the second red team, and the player positions from each of said center player positions to each end 6 and 7 of said second line are alternately for the players of the first and second teams. Thus, the player positions 25, 23 and 21 on one side of the center line and the player positions 26, 28 and 30 on the other side of said center line are for the players of the second red team, whereas the player positions 24, 22 and 20 on one side of said center line and the player positions 27, 29 and 31 on the other side of said center line are for the players of the first team.

The field 1 has a center zone 41 of rectangular configuration marked thereon, equidistantly between the first and second lines 2 and 3 and between the first and second leader positions 32 and 33. The field 1 has a NO PLAY zone 42 of rectangular configuration, extending between the positions of the first and second lines 2 and 3 and centered on the center line 33. The NO PLAY zone 42 extends between the player positions 13 and 14, and 25 and 26.

Manager positions 43 and 44 are provided at the corresponding ends of the center zone 41. The manager position 43 is flanked by umpire positions 45 and 46, respectively, and the manager position 44 is flanked by umpire positions 47 and 48, respectively. A first white team zone, on which play is prohibited, is provided between the lines 35 and 38 and the manager and umpire positions 43, 45 and 46. A second red team zone, on which play is prohibited, is provided between the corresponding lines at the opposite end of the field and the manager and umpire positions 44, 47 and 48.

Figure 2:
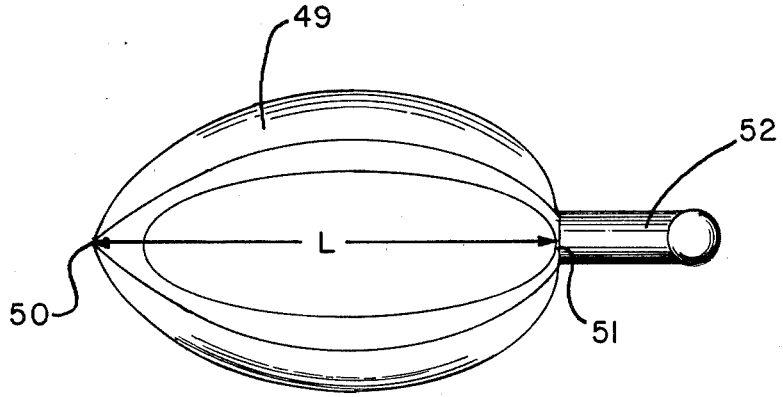
FIG. 2 is a view, on an enlarged scale, of a ball of the field game of the invention.

A pair of identical oval balls, one of which balls 49 is shown in FIG. 2, are provided. Each of the balls is of a color different from the other. Thus, the first team ball is white and the second team ball is red. As shown in FIG. 2, the ball 49 has an axial length L with a pair of spaced opposite ends 50 and 51. A handle member 52 extends coaxially from the ball 49 at the axial end 51 thereof.

Each of the first and second leaders has the ball of the color of his team and throws such ball to the members of his team. Points are scored as the balls are caught by the players of the team or intercepted by the players of the opposing team. The guide lines marked on the field limit the movements of the players of both teams.

Each team has thirteen players, consisting of the leader and twelve additional players. Both teams try to catch the ball thrown by their leaders. They also try to catch the ball thrown by the leader of the opposing team. If a player catches the ball of his team, the team scores one point. If the players of one team catch both balls in play, their team scores two points and have the right to throw the ball again to their own team players. If the players of the same team then catch the ball again, they score three points, which is the maximum permitted for catching the ball in play.

Each player is restricted to a zone marked by the field lines and may move forward or sideways in such zone. If the ball lands in a NO PLAY zone, it is out of play.

If the balls of both teams strike each other in the air, the play is a foul.

The game is played for at least two hours and the team accumulating the highest score wins. Each team has its own manager and four umpires judge the propriety of the play and impose penalties for violation of the rules.

While the invention has been described by means of a specific example and in a specific embodiment, I do not wish to be limited thereto, for obvious modifications will occur to those skilled in the art without departing from the spirit and scope of the invention.

I claim:

1. A field game played by two teams each consisting of a leader and twelve players, said field game comprising a field marked with first and second spaced generally parallel lines of equal length each having spaced opposite first and second ends and twelve player positions marked thereon, first and second leader positions marked on a center line equidistant from the ends of the lines and extending substantially perpendicular thereto, the first leader position being considerably closer to the second line than to the first line and the second leader position being considerably closer to the first line than to the second line, a plurality of lines extending from the first leader position to each player position on the first line and a plurality of lines extending from the second leader position to each player position on the second line; and a pair of identical oval balls each being of a color different from the other and each having an axial length with a pair of spaced opposite ends, each of the balls having a handle member extending coaxially therefrom at one axial end thereof.

2. A field game as claimed in claim 1, wherein the center player positions on the first line on each side of the center line and next-adjacent thereto are for the players of the first team and the player positions from each of the center player positions to each end of the first line are alternately for the players of the second and first teams, and the center player positions on the second line on each side of the center line and next-adjacent thereto are for the players of the second team and the player positins from each of the center player positions to each end of the second line are alternately for the players of the first and second teams.

3. A field game as claimed in claim 2, wherein the field has a center zone of rectangular configuration marked thereon equidistantly between the first and second lines and between the first and second leader positions.

4. A field game as claimed in claim 3, wherein the field has a no play zone of rectangular configuration extending between the center player positions of the first and second lines and centered on the center line.

* * * * *